US010847879B2

(12) United States Patent
Le-Ngoc

(10) Patent No.: US 10,847,879 B2
(45) Date of Patent: Nov. 24, 2020

(54) ANTENNA ARRAY STRUCTURES FOR HALF-DUPLEX AND FULL-DUPLEX MULTIPLE-INPUT AND MULTIPLE-OUTPUT SYSTEMS

(71) Applicant: Tho Le-Ngoc, Montreal (CA)

(72) Inventor: Tho Le-Ngoc, Montreal (CA)

(73) Assignee: HUAWEI TECHNOLOGIES CANADA CO., LTD., Kanata (CA)

( * ) Notice: Subject to any disclaimer, the term of this patent is extended or adjusted under 35 U.S.C. 154(b) by 645 days.

(21) Appl. No.: 15/067,602

(22) Filed: Mar. 11, 2016

(65) Prior Publication Data

US 2017/0264014 A1 Sep. 14, 2017

(51) Int. Cl.
*H01Q 1/52* (2006.01)
*H01Q 21/06* (2006.01)
(Continued)

(52) U.S. Cl.
CPC ..... *H01Q 1/525* (2013.01); *H01Q 1/523* (2013.01); *H01Q 3/28* (2013.01); *H01Q 21/06* (2013.01);
(Continued)

(58) Field of Classification Search
CPC ..... H01Q 1/525; H01Q 1/523; H01Q 21/24; H01Q 1/2283; H04W 36/0085;
(Continued)

(56) References Cited

U.S. PATENT DOCUMENTS 5,955,991 A * 9/1999 Kawakubo ..... G01S 13/345 342/108
5,960,354 A * 9/1999 Einola ..... H04W 36/0085 455/454
(Continued)

FOREIGN PATENT DOCUMENTS

CN 103682625 A 3/2014
CN 104685717 A 6/2015
(Continued)

OTHER PUBLICATIONS

V.I. Okhmatovsky et al., Development of a Cylindrical Waveguide Antenna Array with a High Isolation Between Receive—Transmit Sub arrays: Theory and Experiment, Turkish Journal Electrical Eng Sciences, Elektrik, vol. 10(2), p. 307-316. Sci. & Tech. Res. Council Turkey, 2002 (Year: 2002).*
(Continued)

*Primary Examiner* — Bernarr E Gregory
*Assistant Examiner* — Fred H Mull

(57) ABSTRACT

An antenna having an array structure for full-duplex communication on a same wireless resource is provided, as well a network element including such an antenna and a beamforming processor. A method for transmitting and receiving simultaneously on a same wireless resource using such an antenna is also provided. The antenna includes multiple transmit antenna elements, each of these elements coupled to a respective gain-controlled transmit amplifier. The antenna also includes multiple receive antenna elements, each of these elements coupled to a respective gain-con-
(Continued)

trolled receive amplifier. The antenna also includes an electromagnetic isolation structure located between the plurality of transmit antenna elements and the plurality of receive antenna elements.

25 Claims, 6 Drawing Sheets

(51) Int. Cl.

| | |
|---|---|
| ***H01Q 21/20*** | (2006.01) |
| ***H01Q 25/00*** | (2006.01) |
| ***H01Q 21/08*** | (2006.01) |
| ***H01Q 21/26*** | (2006.01) |
| ***H01Q 21/24*** | (2006.01) |
| ***H01Q 3/28*** | (2006.01) |

(52) U.S. Cl.
CPC ..... *H01Q 21/065* (2013.01); *H01Q 21/08* (2013.01); *H01Q 21/20* (2013.01); *H01Q 21/205* (2013.01); *H01Q 21/24* (2013.01); *H01Q 21/26* (2013.01); *H01Q 25/00* (2013.01)

(58) Field of Classification Search
CPC ... H04W 52/367; G01R 33/345; H04B 1/408; H04B 15/00
See application file for complete search history.

(56) References Cited

U.S. PATENT DOCUMENTS

| | | | | |
|---|---|---|---|---|
| 6,292,134 | B1 * | 9/2001 | Bondyopadhyay | H01Q 3/242 342/374 |
| 6,366,245 | B1 * | 4/2002 | Schmidt | G01S 7/032 343/700 MS |
| 7,299,027 | B2 | 11/2007 | Sudo | |
| 7,408,898 | B1 * | 8/2008 | Brown | H04B 7/18515 370/250 |
| 9,154,217 | B1 * | 10/2015 | Jain | H04B 7/18528 |
| 9,319,252 | B2 | 4/2016 | Li et al. | |
| 2002/0085643 | A1 | 7/2002 | Kitchener et al. | |
| 2003/0011515 | A1 * | 1/2003 | Warble | H01L 21/8258 342/372 |
| 2003/0095067 | A1 * | 5/2003 | Howell | H01Q 3/26 342/377 |
| 2004/0012391 | A1 * | 1/2004 | Vaughan, Jr. | G01R 33/345 324/318 |
| 2005/0200516 | A1 * | 9/2005 | Brown | G01S 13/32 342/90 |
| 2007/0035442 | A1 * | 2/2007 | Manasson | H01Q 21/22 342/375 |
| 2008/0091389 | A1 | 4/2008 | Kim et al. | |
| 2008/0130805 | A1 | 6/2008 | Wang | |
| 2009/0096857 | A1 * | 4/2009 | Frisco | H01Q 3/34 348/14.02 |
| 2009/0251362 | A1 * | 10/2009 | Margomenos | G01S 7/032 342/175 |
| 2010/0231452 | A1 * | 9/2010 | Babakhani | H01Q 9/065 342/368 |
| 2010/0232525 | A1 | 9/2010 | Xia et al. | |
| 2011/0012648 | A1 * | 1/2011 | Qiao | H04B 1/408 327/141 |
| 2011/0208481 | A1 * | 8/2011 | Slastion | G01S 3/48 702/189 |
| 2012/0146869 | A1 | 6/2012 | Holland et al. | |
| 2012/0235857 | A1 * | 9/2012 | Kim | G01S 13/345 342/134 |
| 2013/0028341 | A1 | 1/2013 | Ayach et al. | |
| 2013/0039445 | A1 | 2/2013 | Hwang | |
| 2013/0072796 | A1 * | 3/2013 | Nakamura | A61B 8/4272 600/443 |
| 2013/0090141 | A1 * | 4/2013 | Hottinen | H04B 15/00 455/501 |
| 2013/0163544 | A1 | 6/2013 | Lee et al. | |
| 2013/0258972 | A1 | 10/2013 | Kim et al. | |
| 2013/0329820 | A1 | 12/2013 | Harel et al. | |
| 2014/0045442 | A1 * | 2/2014 | Caruana | H01Q 1/2283 455/78 |
| 2014/0135054 | A1 * | 5/2014 | Chiou | H04W 52/367 455/522 |
| 2014/0341312 | A1 | 11/2014 | Lee et al. | |
| 2015/0092621 | A1 | 4/2015 | Jalloul et al. | |
| 2015/0103934 | A1 | 4/2015 | Nam et al. | |
| 2015/0244436 | A1 | 8/2015 | Le-Ngoc et al. | |
| 2016/0211575 | A1 * | 7/2016 | Tang | H01Q 1/525 |
| 2016/0353294 | A1 | 12/2016 | Wang et al. | |

FOREIGN PATENT DOCUMENTS

| | | | | |
|---|---|---|---|---|
| EP | 2518824 | A1 * | 10/2012 | H01Q 1/243 |
| JP | 07046050 | A * | 2/1995 | |
| WO | WO-2013185708 | A1 * | 12/2013 | H01Q 1/36 |
| WO | WO-2015042953 | A1 * | 4/2015 | H01Q 1/525 |
| WO | WO2015149312 | A1 | 10/2015 | |

OTHER PUBLICATIONS

R. Movahedinia et al., Improvement of Transmit-Receive Array Antenna Isolation by Employing Multilayer EBG Structure, IEEE International Conference on Ubiquitous Wireless Broadband (ICUWB), Oct. 2015 (Year: 2015).*

English Translation of WO 2013185708 A1 (Year: 2018).*

C. Jia et al., A 1-16 GHz Wideband CMOS Low-Noise IF Amplifier for ALMA Radio Astronomy Receivers, IEEE 13th International Conference on Communication Technology, p. 1066-1069, 2011 (Year: 2011).*

B. Henderson et al., Microwave Mixer Technology and Applications, Artech House, p. 431, 2013 (Year: 2013).*

D. Parker et al., Phased Arrays—Part I: Theory and Architectures, IEEE Transactions on Microwave Theory and Techniques, vol. 50(3), p. 678-687, 2002 (Year: 2002).*

C. A. Balanis, Antenna Theory: Analysis and Design, Wiley-Interscience, p. 478-479, 2005 (Year: 2005).*

B.-H Ku, 75-85 GHz Flip-Chip Phased Array RFIC with Simultaneous 8-Transmit and 8-Receive Paths for Automotive Radar Applications, 2013 IEEE Radio Frequency Integrated Circuits Symposium, p. 371-374, 2013 (Year: 2013).*

English Translation of JP 07046050 A (Year: 2019).*

Defintion for between. (2014). Collins English Dictionary (12th ed.). Collins. Credo Reference: https://search.credoreference.com/content/entry/hcengdict/between/0 (Year: 2014).*

M. Niroo-Jazi et al., A Hybrid Isolator to Reduce Electromagnetic Interactions Between Tx/Rx Antennas, IEEE Antennas and Wireless Propagation Letters, vol. 13, p. 75-78, 2014 (Year: 2014).*

X, You et al., Compact dual-element inverted-F MIMO antenna system with enhanced isolation, Microwave and Optical Technology Letters, vol. 15(2), p. 363-368, Feb. 2015 (Year: 2015).*

* cited by examiner

ANTENNA ARRAY STRUCTURES FOR HALF-DUPLEX AND FULL-DUPLEX MULTIPLE-INPUT AND MULTIPLE-OUTPUT SYSTEMS

FIELD

The present disclosure relates generally to antenna structures, and in some aspects, to adaptive antenna array structures for half-duplex and full-duplex multiple-input and multiple-output (MIMO) systems.

BACKGROUND

Some communication systems make use of multiple antenna elements at the transmitter and/or the receiver. For example, MIMO systems involve communication between a transmitter with multiple antenna elements and a receiver with multiple antenna elements. MIMO systems may offer spatial multiplexing, diversity, and beamforming gains compared to systems with a single antenna element at the transmitter and the receiver.

In massive MIMO communication systems, base stations may make use of arrays of antenna elements. The number of antenna elements is larger than a number of parallel streams being transmitted. For example, a multi-user (MU) massive MIMO system may have a base station with hundreds or even thousands of antenna elements simultaneously serving tens of users on a same time-frequency wireless resource.

Massive MIMO may increase the capacity and radiated energy-efficiency of a communications system. The capacity increase may result from aggressive spatial multiplexing. The energy-efficiency increase may result from coherent superposition of wave-fronts emitted by the large number of antennas to focus energy into small regions of space. By shaping the signals transmitted by the large number of antennas, a base station may aim to have wave-fronts collectively emitted by the antennas to add up constructively at the locations of intended receiver terminals, and destructively (or randomly) in other locations.

In some cases, the spectral efficiency of a massive MIMO system may be increased if the antenna elements and the transceiver at a base station allow full-duplex communication. Full-duplex communication involves simultaneous transmission and reception over a same wireless resource.

SUMMARY

In one aspect, there is provided an antenna including a plurality of transmit antenna elements, each of the plurality of transmit elements coupled to a respective gain-controlled transmit amplifier. The antenna also includes a plurality of receive antenna elements, each of the plurality of receive elements coupled to a respective gain-controlled receive amplifier. The antenna also includes an electromagnetic isolation structure between the plurality of transmit antenna elements and the plurality of receive antenna elements.

Optionally, the isolation structure provides reduced self-interference when the antenna is used for transmitting and receiving simultaneously on a same frequency wireless resource.

Optionally, the isolation structure provides an intermediate partition between the transmit antenna elements and the receive antenna elements.

Optionally, the isolation structure is an electromagnetic band gap (EBG) isolator.

Optionally, the plurality of transmit antenna elements is arranged in a first one-dimensional array, and the plurality of receive antenna elements is arranged in a second one-dimensional array.

Optionally, the plurality of transmit antenna elements is arranged in a first two-dimensional array, and the plurality of receive antenna elements is arranged in a second two-dimensional array.

Optionally, the plurality of transmit antenna elements is arranged in a first three-dimensional array, and the plurality of receive antenna elements is arranged in a second three-dimensional array.

Optionally, the first array of transmit elements is a cylindrical array, and the second array of receive elements is a cylindrical array.

Optionally, the first array of transmit elements is a partially spherical array; and the second array of receive elements is a partially spherical array.

Optionally, each of the transmit amplifiers is a power amplifier, and each of the receive amplifiers is a low-noise amplifier.

Optionally, each of the transmit antenna elements is a dual polarized antenna element for transmitting a respective signal having a first polarization and transmitting a respective signal having a second polarization. Also, each of the receive antenna elements is a dual polarized antenna element for receiving a respective signal having a first polarization and receiving respective signal having a second polarization.

Optionally, each of the transmit antenna elements is coupled to the respective transmit amplifier for amplifying the respective transmitted signals having the first polarization and is coupled to a respective second gain-controlled transmit amplifier for transmitting the respective transmitted signals having the second polarization. Also, each of the receive antenna elements is coupled to the respective receive amplifier for amplifying the respective received signals having the first polarization and is coupled to a respective second gain-controlled receive amplifier for receiving the respective received signals having the second polarization.

Optionally, the first and second polarizations of the transmitted signals are orthogonal, and the first and second polarizations of the received signals are orthogonal.

Optionally, each of the gain-controlled transmit amplifiers is mounted proximate to the respective transmit antenna element, and each of the gain-controlled receive amplifiers is mounted proximate to the respective receive antenna element.

Optionally, the number of transmit antenna elements and the number of receive antenna elements are not less than a number of antenna elements of a remote user equipment (UE) in communication with the antenna.

In another aspect, there is provided a network element including an antenna as described above or below, and a beamforming processor for adjusting the respective gains of the transmit amplifiers and the respective gains of the receive amplifiers.

In a further aspect, there is provided a method involving transmitting and receiving simultaneously on a same wireless resource using an antenna having a plurality of transmit antenna elements and a plurality of receive antenna elements partitioned by an isolation structure. The transmitting involves actively adjusting the gains of gain-controlled transmit amplifiers respectively coupled to each of the plurality of transmit antenna elements. The receiving involves actively adjusting the gains of gain-controlled receive amplifiers respectively coupled to each of the plurality of receive antenna elements.

Optionally, transmitting and receiving simultaneously on a same wireless resource includes transmitting and receiving simultaneously on a same frequency wireless resource.

Optionally, adjusting the gains of the gain-controlled transmit amplifiers includes respectively adjusting both amplitude and phase coefficients of transmitted signals for analog beamforming.

Optionally, the transmitting also includes baseband digital precoding.

Optionally, adjusting the gains of the gain-controlled receive amplifiers involves respectively adjusting both amplitude and phase coefficients of received signals for analog beamforming.

Optionally, the receiving also includes at least one of baseband digital post-coding or baseband digital equalization.

Optionally, adjusting the gains of the gain-controlled transmit amplifiers includes adjusting respective first amplitude and phase coefficients of transmitted signals having a first polarization and respective second amplitude and phase coefficients of transmitted signals having a second polarization.

Optionally, adjusting the gains of the gain-controlled receive amplifiers includes adjusting respective first amplitude and phase coefficients of received signals having a first polarization and respective second amplitude and phase coefficients of received signals having a second polarization.

BRIEF DESCRIPTION OF THE DRAWINGS

Examples of embodiments will be described in greater detail with reference to the accompanying drawings, in which.

DETAILED DESCRIPTION

Figure 1:
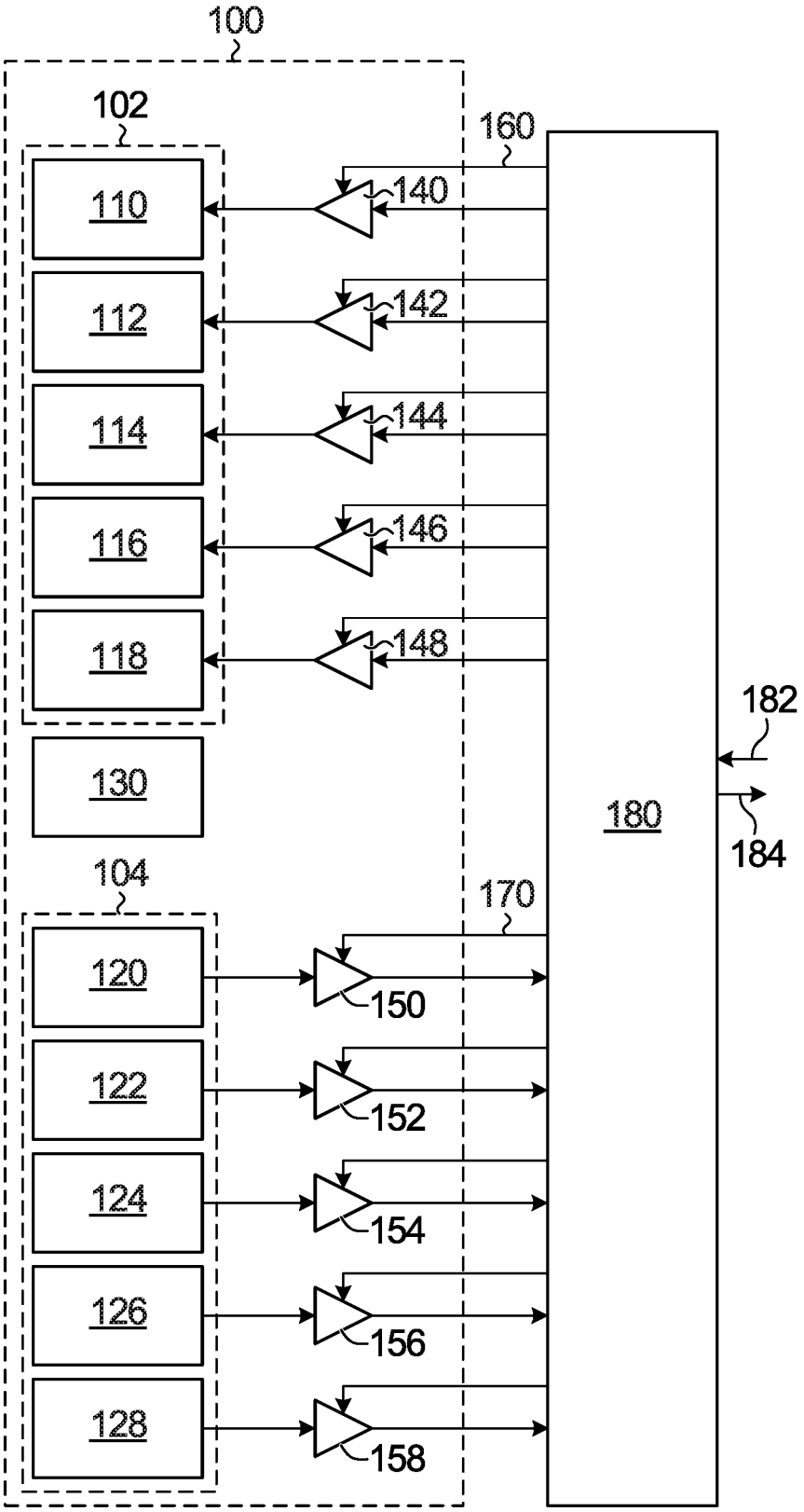
FIG. 1 is a schematic illustration of a network element comprising a beamforming processor and an antenna sub-system having an adaptive antenna array structure in accordance with an embodiment of the invention.

FIG. 1 is a schematic illustration of an example network element comprising a beamforming processor 180 and an active antenna sub-system 100 having an adaptive antenna array structure in accordance with an embodiment of the invention. The network element depicted may be part of a base station, a user equipment (UE), or another type of node, and may be stationary or mobile.

In the example illustrated, antenna sub-system 100 has an array 102 of transmit antenna elements 110, 112, 114, 116, and 118. Antenna sub-system 100 also has an array 104 of receive antenna elements 120, 122, 124, 126, and 128. Located intermediate between the array 102 of transmit antenna elements and the array 104 of receive antenna elements, so as to partition the two arrays 102, 104 of antenna elements, is an electromagnetic isolation structure 130. The array 102 of transmit antenna elements, the electromagnetic isolation structure 130, and the array 104 of receive antenna elements are arranged along a line.

Although the array 102 of transmit antenna elements and the array 104 of receive antenna elements are each illustrated as having five respective antenna elements, it should be understood that this is an example, and that more generally arrays 102, 104 may have more or fewer antenna elements. In some embodiments, the array 102 of transmit antenna elements and the array 104 of receive antenna elements each have a different number of antenna elements. In some embodiments, one or both of arrays 102, 104 have hundreds, thousands, or more antenna elements. In some embodiments, one or both of arrays 102, 104 have a number of antenna elements not less than a number of antenna elements of a remote user equipment (UE) in communication with the antenna sub-system 100. Also, although the arrays 102, 104 are each shown as being arranged along a line, it should be understood that other configurations of arrays 102, 104 are contemplated, including two-dimensional (2D) and three-dimensional (3D) array configurations.

Although the antenna elements of arrays 102, 104 are illustrated as having a square shape and being oriented so that a side of each square antenna element faces a side of another square antenna element, it should be understood that this configuration is an example and that other shapes and orientations of antenna elements are contemplated. For example, each antenna element of arrays 102, 104 may be formed from a pair of overlapping micro-strips forming a cross shape. As another example, the antenna elements of arrays 102, 104 may have a square shape and have an orientation rotated 45 degrees clockwise in the plane from the orientation illustrated in FIG. 1.

Each of the transmit antenna elements 110, 112, 114, 116, 118 is coupled to the output of a respective gain-controlled transmit amplifier 140, 142, 144, 146, 148 having an input coupled to the beamforming processor 180. For each gain-controlled transmit amplifier, there is a control line coupled from beamforming processor 180 to the gain-controlled transmit amplifier that permits the beamforming processor 180 to adjust individual amplifier gain. For simplicity, only the control line 160 for transmit amplifier 140 is labelled in FIG. 1. In an example embodiment, the gain-controlled transmit amplifiers 140, 142, 144, 146, 148 are power amplifiers. In some embodiments, for example some embodiments where the transmit antenna elements 110, 112, 114, 116, 118 are single-polarized antenna elements, a means of adjusting the phase of the outputs of gain-controlled transmit amplifiers 140, 142, 144, 146, 148 is also provided. For example, gain-controlled transmit amplifiers 140, 142, 144, 146, 148 may be configured to have a variable phase shift, and additional control lines from beamforming processor 180 may be provided to control the respective phase shifts of each of the gain-controlled transmit amplifiers 140, 142, 144, 146, 148. In another example embodiment, phase shifters may be located in series with each of the gain-controlled transmit amplifiers 140, 142, 144, 146, 148, and control lines from beamforming processor 180 may be provided to control the phase shifts of each respective phase shifter.

Each of the receive antenna elements 120, 122, 124, 126, 128 is coupled to the input of a respective gain-controlled receive amplifier 150, 152, 154, 156, 158 whose output is coupled to beamforming processor 180. For each gain-controlled receive amplifier, there is a control line coupled from beamforming processor 180 to the gain-controlled receive amplifier that permits the beamforming processor 180 to adjust individual amplifier gain. For simplicity, only the control line 170 for receive amplifier 150 is labelled in FIG. 1. In an example embodiment, the gain-controlled receive amplifiers 150, 152, 154, 156, 158 are low noise amplifiers (LNAs). In some embodiments, for example some embodiments where the receive antenna elements 150, 152, 154, 156, 158 are single-polarized antenna elements, a means of adjusting the phase of the outputs of gain-controlled receive amplifiers 150, 152, 154, 156, 158 is also provided. For example, gain-controlled receive amplifiers 150, 152, 154, 156, 158 may be configured to have a variable phase shift, and additional control lines from beamforming processor 180 may be provided to control the respective phase shifts of each of the gain-controlled receive amplifiers 150, 152, 154, 156, 158. In another example embodiment, phase shifters may be located in series with each of the gain-controlled receive amplifiers 150, 152, 154, 156, 158, and control lines from beamforming processor 180 may be provided to control the phase shifts of each respective phase shifter.

In some embodiments, beamforming processor 180 is a digital signal processor (DSP). In other embodiments, beamforming processor 180 is a general purpose processor under software and/or firmware control, a custom application-specific integrated circuit (ASIC), another type of processor capable of performing beamforming, or a combination of any of the foregoing. Beamforming processor 180 may also be coupled to a controller that supplies instructions for the operation of beamforming processor 180. Although beamforming processor 180 is shown in FIG. 1 as being separate from antenna sub-system 100, in some embodiments beamforming processor 180 and antenna sub-system 100 may be combined in a single assembly.

In the illustrated embodiment, the gain-controlled transmit amplifiers 140, 142, 144, 146, 148 and the gain-controlled receive amplifiers 150, 152, 154, 156, 158 are illustrated as being located to the right of their respective antenna elements. It should be understood that the specific location shown is simply for diagrammatic purposes. In some embodiments, the gain-controlled amplifiers may be located on a substrate that also supports the array 102 of transmit antenna elements and the array 104 of receive antenna elements. In some embodiments, the gain-controlled amplifiers may be located behind their respective antenna elements. In other embodiments, the gain-controlled amplifiers may be located elsewhere in proximity to their respective antenna elements. By distributing the gain-controlled transmit amplifiers in proximity to their respective transmit antenna elements, in some cases power efficiency and heat distribution may be improved. By distributing the gain-controlled receive amplifiers in proximity to their respective receive antenna elements, in some cases noise and loss characteristics may be improved. In other embodiments, the gain-controlled transmit and receive amplifiers may be located in other locations, for example on a different substrate than a substrate that supports the array 102 of transmit antenna elements and the array 104 of receive antenna elements.

Electromagnetic isolation structure 130 is provided to improve isolation between signals transmitted from the array 102 of transmit antenna elements and signals received by the array 104 of receive antenna elements during full-duplex operation of antenna sub-system 100, that is, when the arrays 102, 104 are respectively transmitting and receiving simultaneously over a same wireless resource. In some embodiments, electromagnetic isolation structure 130 is an electromagnetic band gap (EBG) isolator which may have a belt or ring structure. In other embodiments, electromagnetic isolation structure 130 is an assembly of electromagnetic absorber material or another structure providing electromagnetic isolation. In some embodiments, electromagnetic isolation structure 130 is a plurality of isolation structures located in proximity to each other. For example, several EBG stages may be cascaded to provide more isolation than a single EBG isolator.

The specific level of electromagnetic isolation provided by electromagnetic isolation structure 130 during full-duplex operation of antenna sub-system 100 may depend on the specific application of antenna sub-system 100 and/or the specific configuration of the array 102 of transmit antenna elements and the array 104 of receive antenna elements. In typical applications, electromagnetic isolation structure 130 may provide 40 to 50 dB of electromagnetic isolation. In some applications, for example antenna structures having a small number of antenna elements, antenna structures in which arrays 102, 104 are located in close proximity to each other, or antenna structures which are designed for shorter range transmission and/or in small cells, lower levels of electromagnetic isolation may be selected. In some applications, electromagnetic isolation structure 130 may provide a high level of electromagnetic isolation, such as 50 to 80 dB or more of electromagnetic isolation. In some embodiments, other self-interference cancellation techniques may be applied in addition to the use of electromagnetic isolation structure 130 for a greater level of effective isolation between signals transmitted and received from antenna sub-system 100.

In transmitting operation, beamforming processor 180 receives streams for transmission via an input 182. Beamforming processor 180 performs adaptive analog beamforming by actively controlling both amplitude and phase coefficients of signals transmitted by respective transmit antenna elements 110, 112, 114, 116, 118. For example, in some embodiments, beamforming processor 180 adjusts the gains of the gain-controlled transmit amplifiers 140, 142, 144, 146, 148 to control both amplitude and phase coefficients of signals transmitted by respective transmit antenna elements 110, 112, 114, 116, 118. In embodiments where means of directly adjusting the phase of the outputs of the gain-controlled transmit amplifiers 140, 142, 144, 146, 148 are provided, beamforming processor 180 uses these means to adjust the phase coefficients of signals transmitted by respective transmit antenna elements 110, 112, 114, 116, 118. In some embodiments, beamforming processor 180 may perform baseband digital precoding and/or other digital coding of the streams for transmission in a processing stage before the analog beamforming.

In receiving operation, beamforming processor 180 performs adaptive analog beamforming on signals received by receive antenna elements 120, 122, 124, 126, and 128 by actively affecting amplitude and phase coefficients of the received signals. For example, in some embodiments, beamforming processor 180 actively adjusts the gains of the respective gain-controlled receive amplifiers 150, 152, 154, 156, 158 to affect amplitude and phase coefficients of signals received by receive antenna elements 120, 122, 124, 126, 128. In embodiments where means of directly adjusting the phase of the outputs of the gain-controlled receive amplifiers 150, 152, 154, 156, 158 are provided, beamforming processor 180 uses these means to affect the phase coefficients of signals received by respective receive antenna elements 120, 122, 124, 126, 128. In some embodiments, beamforming processor 180 may perform baseband digital post-coding, baseband digital equalization, and/or other digital coding of received streams in a processing stage after the analog beamforming. Beamforming processor 180 outputs received streams after processing through an output 184.

In some embodiments, the network element comprising beamforming processor 180 and antenna sub-system 100 may transmit and receive simultaneously on a same wireless resource, such as a same wireless frequency resource, for full-duplex operation. In other embodiments, the network element may transmit and receive simultaneously on different wireless resources. In still other embodiments, the network element may transmit and receive at different times for half-duplex operation, either on a same or a different wireless resource.

In some antenna structures that do not include isolation structure 130, large numbers of antenna elements can complicate the implementation of some signal processing operations, for example precoding and beamforming, during full-duplex operation. In the embodiment illustrated in FIG. 1, because electromagnetic isolation structure 130 provides isolation between array 102 of transmit antenna elements and array 104 of receive antenna elements, the implementation of some such signal processing operations during full-duplex operation may be simplified in comparison to alternative antenna structures that do not include isolation structure 130.

Figure 2:
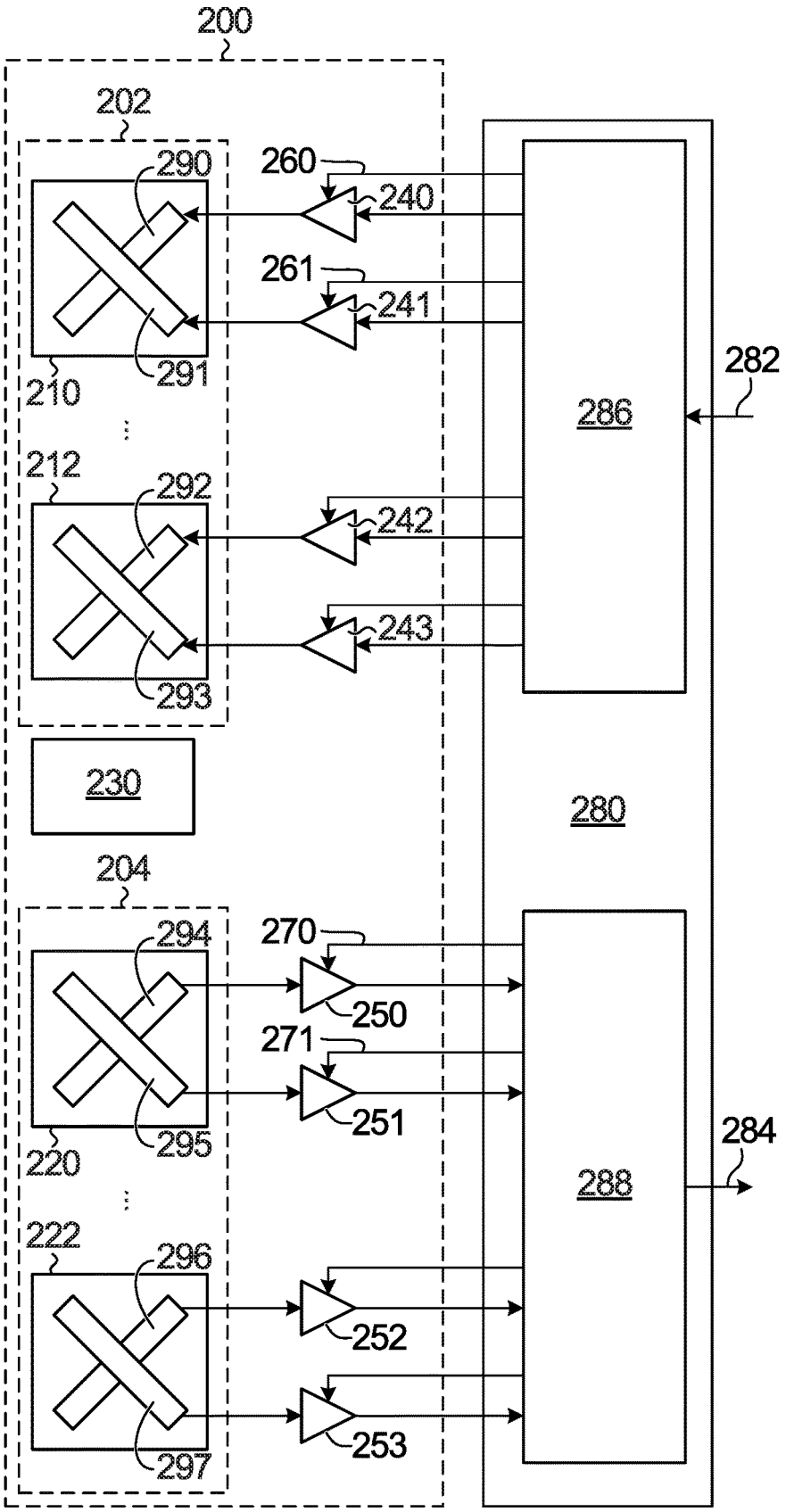
FIG. 2 is a schematic illustration of network element comprising a beamforming processor and an antenna sub-system having a dual polarized adaptive antenna array structure in accordance with an embodiment of the invention.

FIG. 2 is a schematic illustration of an example network element comprising a beamforming processor 280 and an antenna sub-system 200 having a dual-polarized adaptive antenna array structure in accordance with an embodiment of the invention.

In the example illustrated, antenna sub-system 200 has an array 202 of transmit antenna elements 210, 212. Antenna sub-system 200 also has an array 204 of receive antenna elements 220, 222. Located intermediate between the array 202 of transmit antenna elements and the array 204 of receive antenna elements, so as to partition the two arrays 202, 204 of antenna elements, is an electromagnetic isolation structure 230. The array 202 of transmit antenna elements, the electromagnetic isolation structure 230, and the array 204 of receive antenna elements lie on a plane and are arranged along a line. Although an example configuration of antenna sub-system 200 is illustrated in FIG. 2, it should be understood that other configurations are possible. For example, array 202 of transmit antenna elements and/or array 204 of antenna elements may include a larger number of antenna elements or may have other spatial configurations, such as two-dimensional (2D) and three-dimensional (3D) array configurations.

Each of the transmit antenna elements 210, 212 and receive antenna elements 220, 222 is a dual polarized antenna element. Each dual polarized antenna element comprises a substrate and a respective first sub-element 290, 292, 294, 296 and a respective second sub-element 291, 293, 295, 297 for transmitting or receiving signals having first and second polarizations, respectively. In some embodiments, the first and second respective polarizations are orthogonal. In the embodiment shown in FIG. 2, each first sub-element 290, 292, 294, 296 and the corresponding second sub-element 291, 293, 295, 297 are overlapping microstrip antenna elements oriented perpendicularly to one another. However, it should be understood that other dual polarized antenna element types could also be used, such as dual polarized patch antenna elements.

Each of the first and second sub-elements 290, 291, 292, 293 of the transmit antenna elements is coupled to the output of a respective gain-controlled transmit amplifier 240, 241, 242, 243 whose input is coupled to a transmit beamforming unit 286 of a beamforming processor 280. For each gain-controlled transmit amplifier, there is a control line coupled from beamforming processor 280 to transmit beamforming unit 286 that permits adjustment of individual amplifier gain. For simplicity, only control lines 260 and 261 for transmit amplifiers 240 and 241, respectively, are labelled in FIG. 2.

Each of the first and second sub-elements 294, 295, 296, 297 of the receive antenna elements is coupled to the input of a respective gain-controlled receive amplifier whose output is coupled to a receive beamforming unit 288 of a beamforming processor 280. For each gain-controlled receive amplifier, there is a control line coupled from beamforming processor 280 to receive beamforming unit 288 that permits adjustment of individual amplifier gain. For simplicity, only control lines 270 and 271 for receive amplifiers 250 and 251, respectively, are labelled in FIG. 2.

In transmitting operation, transmit beamforming unit 286 receives streams for transmission via an input 282. Transmit beamforming unit 286 performs adaptive analog beamforming by actively adjusting the gains of the gain-controlled transmit amplifiers 240, 242 respectively coupled to the first sub-elements 290, 292 to control both amplitude and phase coefficients of respective signals transmitted with the first polarization. Transmit beamforming unit 286 also performs adaptive analog beamforming by actively adjusting the gains of the gain-controlled transmit amplifiers 241, 243 respectively coupled to the second sub-elements 291, 293 to control both amplitude and phase coefficients of respective signals transmitted with the second polarization. In some embodiments, transmit beamforming unit 286 performs baseband digital precoding and/or other digital coding of the streams for transmission in a processing stage before the analog beamforming.

In receiving operation, receive beamforming unit 288 performs adaptive analog beamforming on signals having a first polarization received by first sub-elements 294, 296 and signals having a second polarization received by second sub-elements 295, 297. Receive beamforming unit 288 performs the adaptive analog beamforming by actively adjusting the gains of the gain-controlled receive amplifiers 250, 251, 252, 253 to affect amplitude and phase coefficients of the received signals. In some embodiments, receive beamforming unit 288 may perform baseband digital post-coding, baseband digital equalization, and/or other digital coding of received streams in a processing stage after the analog beamforming. Receive beamforming unit 288 outputs received streams after processing through an output 284.

Figure 3A:
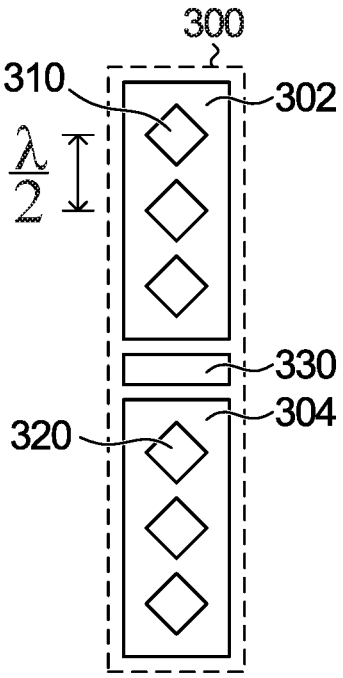
FIG. 3A a diagrammatic illustration of an antenna having a one-dimensional (1D) array structure in accordance with an embodiment of the invention.

FIG. 3A a diagrammatic illustration of an antenna 300 having a one-dimensional (1D) array structure in accordance with an embodiment of the invention.

In the illustrated embodiment, antenna 300 has an array 302 of transmit antenna elements 310. Antenna 300 also has an array 304 of receive antenna elements 320. Located intermediate between the array 302 of transmit antenna elements and the array 304 of receive antenna elements, so as to partition the two arrays 302, 304 of antenna elements, is an electromagnetic isolation structure 330. The array 302 of transmit antenna elements, the electromagnetic isolation structure 330, and the array 304 of receive antenna elements lie on a plane and are arranged along a line. In the illustrated embodiment, each of the two arrays 302, 304 has three antenna elements. However, it should be understood that more or fewer antenna elements may be used in each of the two arrays 302, 304, and the number of antennas in each array may differ.

In some embodiments, the array 302 of transmit antenna elements, the electromagnetic isolation structure 330, and the array 304 of receive antenna elements are supported by a single substrate, such as a fiberglass printed circuit board (PCB) material. However, it should be understood that other configurations are possible. For example, the array 302 of transmit antenna elements and the array 304 of receive antenna elements may each be located on individual substrates, and a physical substructure may support arrays 302, 304 and electromagnetic isolation structure 330.

In the illustrated embodiment, transmit antenna elements 310 and receive antenna elements 320 are illustrated as having a diamond shape and being oriented such that a corner of each diamond is proximate to a corner of another diamond. However, it should be understood that this configuration is an example and that other shapes and orientations of antenna elements are contemplated. In the illustrated embodiment, the spacing between the centroids of adjacent transmit antenna elements 310 is $\lambda/2$, where $\lambda$ is a wavelength of signals expected to be transmitted and received by the antenna 300. The spacing between the centroids of adjacent receive antenna elements 320 is also $\lambda/2$. In some example embodiments, $\lambda$ may be 111 mm (for 2.7 GHz communication), 136 mm (for 2.2 GHz communication), or 176.5 mm (for 1.7 GHz communication).

Figure 3B:
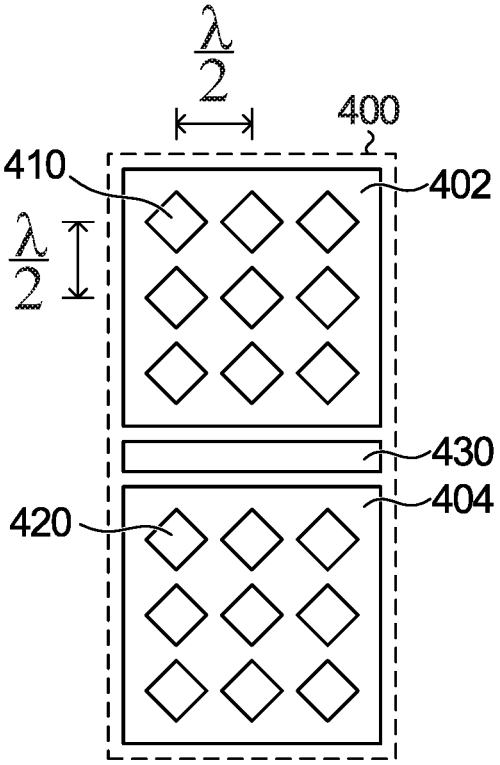
FIG. 3B is a diagrammatic illustration of an antenna having a two-dimensional (2D) array structure in accordance with an embodiment of the invention.

FIG. 3B is a diagrammatic illustration of an antenna 400 having a two-dimensional (2D) array structure in accordance with an embodiment of the invention.

Antenna 400 has an array 402 of transmit antenna elements 410. Antenna 400 also has an array 404 of receive antenna elements 420. Located intermediate between the array 402 of transmit antenna elements and the array 404 of receive antenna elements, so as to partition the two arrays 402, 404 of antenna elements, is an electromagnetic isolation structure 430. The array 402 of transmit antenna elements, the electromagnetic isolation structure 430, and the array 404 of receive antenna elements lie on a plane. Each of the two arrays 402, 404 is arranged in a regular 2D grid in the plane. In the illustrated embodiment, the spacing between the centroid of each of the antenna elements in each of the two arrays 402, 404 is $\lambda/2$. However, other configurations of antenna elements are possible. In particular, each of the two arrays 402, 404 does not have to include a square number of antenna elements arranged in a square. For example, rectangular arrays 402, 404 of antenna elements may be used in some embodiments. It should be understood that the specific shape of arrays 402, 404 and the specific number of transmit antenna elements 410 and receive antenna elements 420 are design choices. These design choices may depend, for example, on whether an intended application of antenna 400 is to have just one beam with large coverage if multiple users are clustered in one area, or many beams, each with more narrow coverage for individual users and/or groups of clustered users. In the illustrated embodiment, each of the two arrays 402, 404 has nine antenna elements. However, it should be understood that more or fewer antenna elements may be used in each of the two arrays 402, 404, and the number of antennas in each array may differ.

Figure 3C:
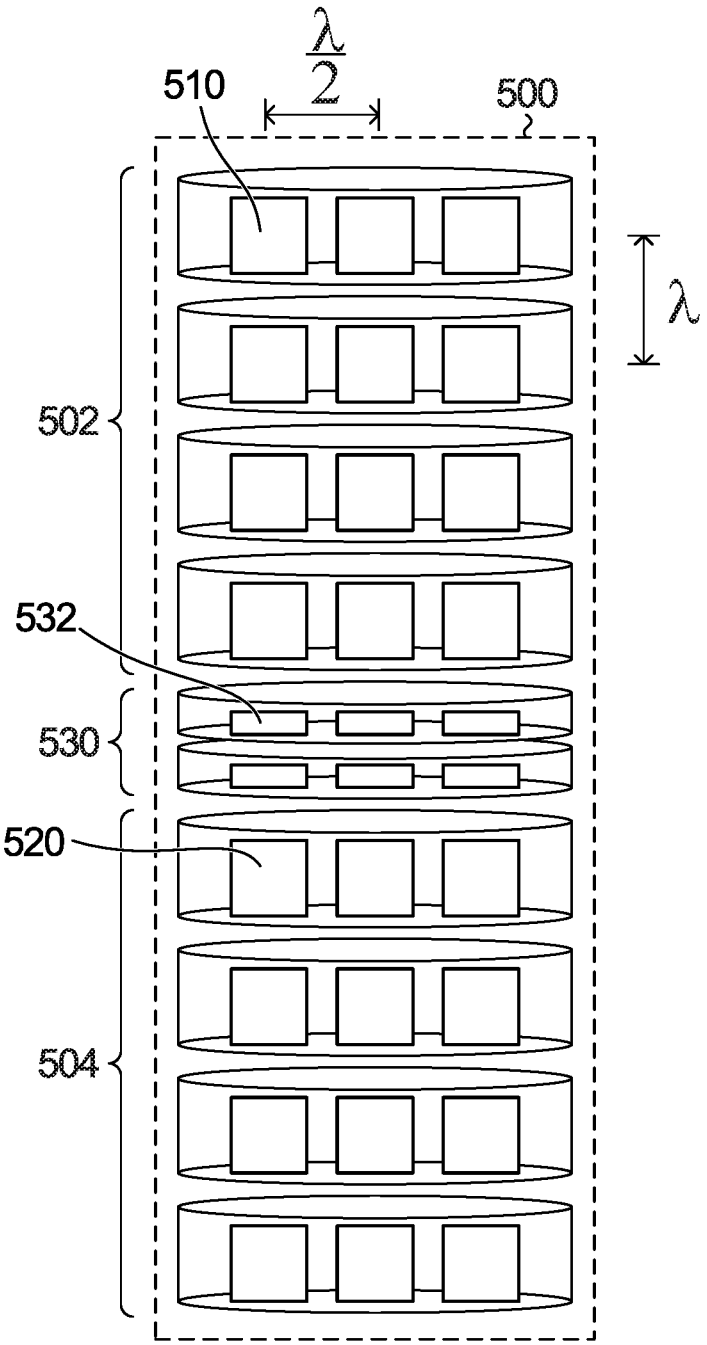
FIG. 3C is a diagrammatic illustration of an antenna having a cylindrical three-dimensional (3D) array structure in accordance with an embodiment of the invention.

FIG. 3C is a diagrammatic illustration of an antenna 500 having a cylindrical 3D array structure in accordance with an embodiment of the invention.

Antenna 500 has an array 502 of transmit antenna elements 510. Antenna 500 also has an array 504 of receive antenna elements 520. Located intermediate between the array 502 of transmit antenna elements and the array 504 of receive antenna elements, so as to partition the two arrays 502, 504 of antenna elements, is an electromagnetic isolation structure 530 having a plurality of EBG isolators 532.

In the illustrated embodiment, the array 502 of transmit antenna elements has a cylindrical shape formed from four ring-shaped support structures aligned along a central axis. Transmit antenna elements 510 are planar, square in shape, evenly spaced around each ring-shaped support structure, and mounted tangentially to the cylindrical shape formed from the ring-shaped support structures. In other embodiments, each transmit antenna element 510 may be curved so as to follow the cylindrical shape formed from the ring-shaped support structures. In the illustrated embodiment, the circumferential spacing between the transmit antenna elements 510 is $\lambda/2$. The longitudinal spacing between the transmit antenna elements 510 is $\lambda$.

In the illustrated embodiment, the array 504 of receive antenna elements has the same configuration as the array 502 of transmit antenna elements. The electromagnetic isolation structure 530 has a cylindrical shape with a same diameter as the arrays 502, 504 formed from two ring-shaped support structures aligned along the central axis. In the illustrated embodiment, rectangular EBG isolators 532 are distributed evenly around these two ring-shaped support structures. In some embodiments, other shapes and/or distributions of EBG isolation material may be used. For example, individual EBG isolators 532 may be square in shape. More generally, in embodiments that employ EBG isolators 532, the electromagnetic isolation structure 530 may consist of a plurality of regular and/or irregular EBG isolators 532. In other embodiments, other isolating materials may be used for the electromagnetic isolation structure 530. For example, a solid ring or disc of permalloy and/or mu-metal isolation material may be disposed between the array 504 of transmit antenna elements and the array 504 of receive antenna elements. It should be understood that the choice of material for electromagnetic isolation structure 530 is a design choice that may depend, for example, on isolation requirements for particular applications and/or physical/environmental limitations.

In a particular example of the antenna 500 shown in FIG. 3C and intended for communication at 2.2 GHz, each of the array 502 of transmit antenna elements and the array 504 of receive antenna elements has 64 antenna elements. Each antenna element 510, 520 has a square shape that is $\lambda/2$ by $\lambda/2$ in size (68 mm by 68 mm). The antenna elements 510, 520 in each of the arrays 502, 504 of transmit and receive elements have a $\lambda/2$ circumferential spacing and a $\lambda$ vertical spacing. For a maximum total downlink radiated power of 1 W, each of the transmit antenna elements 510 handles at most 16 mW of power.

In another particular example of an antenna having a cylindrical shape like the antenna 500 shown in FIG. 3C and intended for communication at 2.2 GHz, each of the array 502 of transmit antenna elements and the array 504 of receive antenna elements has 640 omnidirectional antenna elements. Each antenna element 510, 520 has a square shape that is $\lambda/2$ by $\lambda/2$ in size (7 by 7 cm), for a combined radiating area of $640\times(\lambda/2)^2=3\ m^2$. The antenna may be configured to transmit at a total power of 12 W, with each of the transmit antenna elements handling 19 mW of power. For analysis and simulation, the height of the array 502 of transmit antenna elements is assumed to be 30 m.

In a numerical simulation of this example antenna, the antenna may, for example, serve 100 fixed terminals, each terminal having 8 dB gain antennas with a height of 5 m, the fixed terminals being randomly distributed in a disk of radius 6 km centered on the array of transmit antenna elements. Applying the Hata-COST231 radio propagation model, path loss may be 127 dB at 1 km range and the range-decay exponent may be 3.52, assuming log-normal shadow fading having 8 dB standard deviation. The receivers may have a 9 dB gain noise figure. If maximum-ratio transmission (MRT) beamforming is used for the downlink and maximal-ratio combining (MRC) is used for the uplink, the example antenna may offer the 100 terminals an estimated total downlink throughput of 2 Gb/s, resulting in a sum-spectral efficiency of 100 bps/Hz.

Figure 3D:
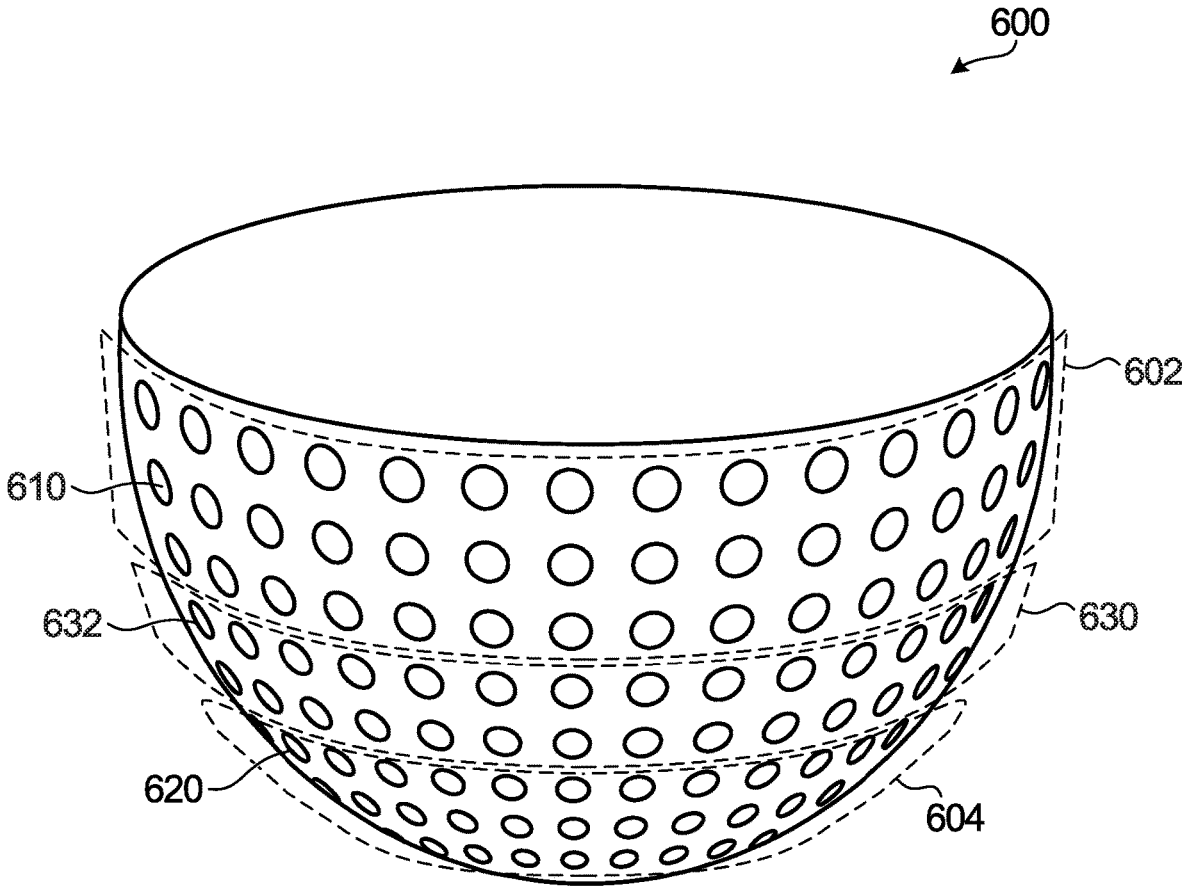
FIG. 3D is a diagrammatic illustration of an antenna having a hemi-spherical three-dimensional array structure in accordance with an embodiment of the invention.

The cylindrical 3D antenna array structures illustrated in FIG. 3C and discussed above are provided as examples. Other 3D antenna array structures may be also be used. FIG. 3D is a diagrammatic illustration of an antenna having a hemi-spherical 3D array structure in accordance with an embodiment of the invention.

In the illustrated embodiment, antenna 600 has an array 602 of transmit antenna elements 610. Antenna 600 also has an array 604 of receive antenna elements 620. The arrays 602, 604 each have a substrate with a partially spherical shape arranged along on the surface of a hemisphere. Located intermediate between partially spherical arrays 602, 604 is a plurality 630 of EBG isolation elements 632 arranged along the surface of the hemisphere. In the illustrated embodiment, transmit antenna elements 610 are circular in shape and arranged in a regular pattern along the partially spherical substrate. The array 604 of receive antenna elements 620 has an analogous configuration as the array 602 of transmit antenna elements. EBG isolation elements 632 also are circular in shape and arranged in a regular pattern. However, it should be understood that the specific configuration of transmit antenna elements 610, receive antenna elements 620, and EBG isolation elements 632 is a design choice. For example, transmit antenna elements 610, receive antenna elements 620, and EBG isolation elements 632 may be planar or curved and circular, square, rectangular, or polygonal in shape. In a particular embodiment, transmit antenna elements 610 and receive antenna elements 620 are generally pentagonal in shape and spaced apart in the same manner as the dark portions of a soccer ball. In a particular embodiment, antenna 600 may include mounting hardware for being physically mounted to the ceiling of a room.

Figure 4:
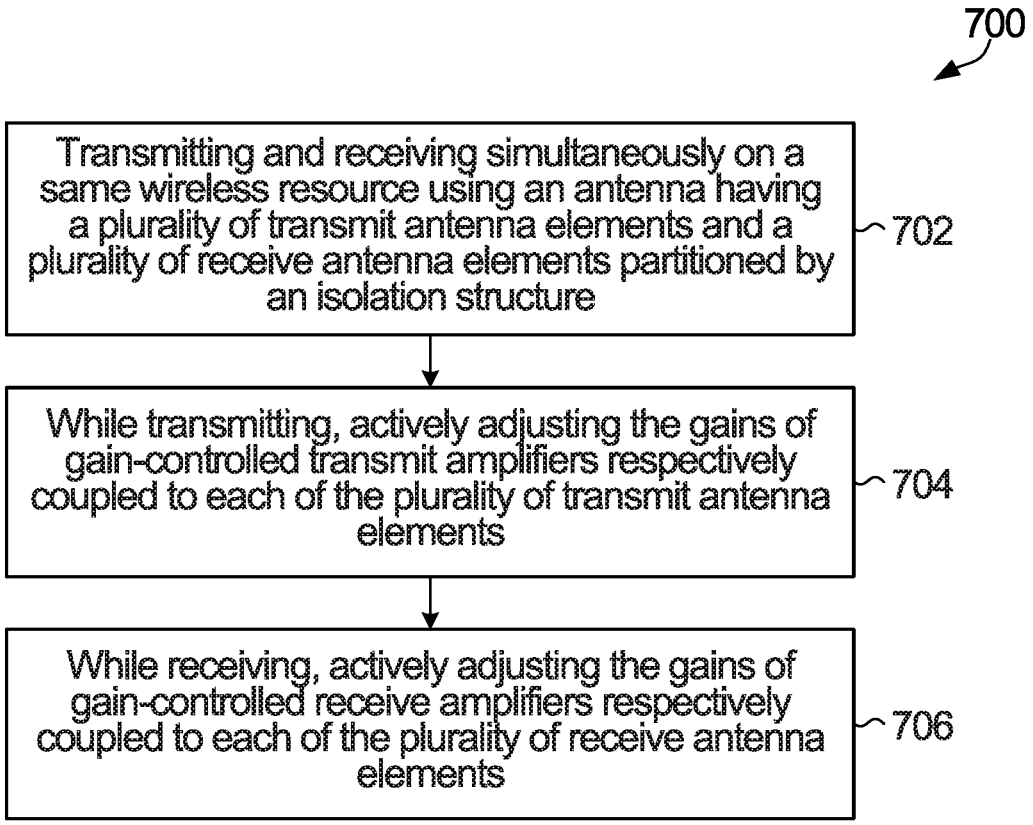
FIG. 4 is a flow diagram of a method for transmitting and receiving simultaneously on a same wireless resource in accordance with an embodiment of the invention.

FIG. 4 is a flow diagram of a method 700 for transmitting and receiving simultaneously on a same wireless resource in accordance with an embodiment of the invention. At block 702, an antenna is used to transmit and receive simultaneously on a same wireless resource having a plurality of transmit antenna elements and a plurality of receive antenna elements partitioned by an isolation structure. In some alternate embodiments, some of the time the antenna may not transmit and receive simultaneously on a same wireless resource. The antenna may transmit and receive on different wireless resources some of the time and/or transmit and receive at non-overlapping times.

While transmitting, at block 704, the gains of gain-controlled transmit amplifiers respectively coupled to each of the plurality of transmit antenna elements are actively adjusted. This active adjustment may comprise analog beamforming by respectively adjusting both amplitude and phase coefficients of transmitted signals. In embodiments where the transmit antenna elements have dual polarization, the analog beamforming may involve adjusting respective first amplitude and phase coefficients of transmitted signals having a first polarization and respective second amplitude and phase coefficients of transmitted signals having a second polarization. In some embodiments, baseband digital precoding may be performed prior to analog beamforming.

While receiving, at block 706, the gains of gain-controlled receive amplifiers respectively coupled to each of the plurality of receive antenna elements are actively adjusted. This active adjustment may comprise analog beamforming by respectively adjusting both amplitude and phase coefficients of received signals. In embodiments where the receive antenna elements have dual polarization, the analog beamforming may involve adjusting respective first amplitude and phase coefficients of received signals having a first polarization and respective second amplitude and phase coefficients of received signals having a second polarization. In some embodiments, while receiving, baseband digital post-coding and/or baseband digital equalization may be performed after analog beamforming.

In some embodiments, a non-transitory computer readable medium comprising instructions for execution by a processor may be provided to control execution of the method 700 illustrated in FIG. 4, to implement another method described above, and/or to facilitate the implementation and/or operation of an apparatus described above. In some embodiments, the processor may be a component of a general-purpose computer hardware platform. In other embodiments, the processor may be a component of a special-purpose hardware platform. For example, the processor may be an embedded processor, and the instructions may be provided as firmware. Some embodiments may be implemented by using hardware only. In some embodiments, the instructions for execution by a processor may be embodied in the form of a software product. The software product may be stored in a non-volatile or non-transitory storage medium, which can be, for example, a compact disc read-only memory (CD-ROM), universal serial bus (USB) flash disk, or a removable hard disk.

The previous description of some embodiments is provided to enable any person skilled in the art to make or use an apparatus, method, or processor readable medium according to the present disclosure. Various modifications to these embodiments will be readily apparent to those skilled in the art, and the generic principles of the methods and devices described herein may be applied to other embodiments. Thus, the present disclosure is not intended to be limited to the embodiments shown herein but is to be accorded the widest scope consistent with the principles and novel features disclosed herein.

What is claimed is:

1. An apparatus comprising:

an antenna comprising:

a plurality of transmit antenna elements mounted on a first substrate, each of the plurality of transmit elements coupled to a respective gain-controlled transmit amplifier;

a plurality of receive antenna elements mounted on a second substrate, each of the plurality of receive elements coupled to a respective gain-controlled receive amplifier; and an electromagnetic isolation structure different from and directly between the first substrate and the second substrate, and between the plurality of transmit antenna elements and the plurality of receive antenna elements, wherein the isolation structure provides an intermediate partition between the transmit antenna elements and the receive antenna elements, and provides reduced self-interference when the antenna is used for transmitting and receiving simultaneously on a same frequency wireless resource; and a beamforming processor, coupled to each of the transmit amplifiers and to each of the receive amplifiers, for individually adjusting the respective gains of the transmit amplifiers and the respective gains of the receive amplifiers, wherein:

a first gain of at least one transmit amplifier during a first transmission from the antenna is different from a second gain of the at least one transmit amplifier during a second transmission from the antenna, and a first gain of at least one receive amplifier during a first reception by the antenna is different from a second gain of the at least one receive amplifier during a second reception by the antenna.

2. The apparatus of claim 1, wherein the isolation structure is an electromagnetic band gap (EBG) isolator.

3. The apparatus of claim 1, wherein the plurality of transmit antenna elements is arranged in a first one-dimensional array; and the plurality of receive antenna elements is arranged in a second one-dimensional array.

4. The apparatus of claim 1, wherein the plurality of transmit antenna elements is arranged in a first two-dimensional array; and the plurality of receive antenna elements is arranged in a second two-dimensional array.

5. The apparatus of claim 1, wherein the plurality of transmit antenna elements is arranged in a first three-dimensional array; and the plurality of receive antenna elements is arranged in a second three-dimensional array.

6. The apparatus of claim 1, wherein the first array of transmit elements is a cylindrical array; and the second array of receive elements is a cylindrical array.

7. The apparatus of claim 1, wherein the first array of transmit elements is a partially spherical array; and the second array of receive elements is a partially spherical array.

8. The apparatus of claim 1, wherein each of the transmit amplifiers is a power amplifier; and each of the receive amplifiers is a low-noise amplifier.

9. The apparatus of claim 1, wherein each of the transmit antenna elements is a dual polarized antenna element for transmitting a respective signal having a first polarization and transmitting a respective signal having a second polarization, each of the receive antenna elements is a dual polarized antenna element for receiving a respective signal having a first polarization and receiving respective signal having a second polarization.

10. The apparatus of claim 9, wherein each of the transmit antenna elements is coupled to the respective transmit amplifier for amplifying the respective transmitted signals having the first polarization and is coupled to a respective second gain-controlled transmit amplifier for transmitting the respective transmitted signals having the second polarization, and each of the receive antenna elements is coupled to the respective receive amplifier for amplifying the respective received signals having the first polarization and is coupled to a respective second gain-controlled receive amplifier for receiving the respective received signals having the second polarization.

11. The apparatus of claim 9, wherein the first and second polarizations of the transmitted signals are orthogonal; and the first and second polarizations of the received signals are orthogonal.

12. The apparatus of claim 1, wherein each of the gain-controlled transmit amplifiers are mounted on the first substrate; and each of the gain-controlled receive amplifiers are mounted on the second substrate.

13. The apparatus of claim 1, wherein the number of transmit antenna elements and the number of receive antenna elements are not less than a number of antenna elements of a remote user equipment (UE) in communication with the antenna.

14. The apparatus of claim 1, wherein the antenna permits transmitting a stream on the frequency wireless resource and receiving a different stream on the frequency wireless resource simultaneously.

15. A network element comprising:

an antenna comprising:

a plurality of transmit antenna elements mounted on a first substrate, each of the plurality of transmit elements coupled to a respective gain-controlled transmit amplifier;

a plurality of receive antenna elements mounted on a second substrate, each of the plurality of receive elements coupled to a respective gain-controlled receive amplifier; and an electromagnetic isolation structure different from and directly between the first substrate and the second substrate, and between the plurality of transmit antenna elements and the plurality of receive antenna elements, wherein the isolation structure provides an intermediate partition between the transmit antenna elements and the receive antenna elements, and provides reduced self-interference when the antenna is used for transmitting and receiving simultaneously on a same frequency wireless resource; and a beamforming processor, coupled to each of the transmit amplifiers and to each of the receive amplifiers, for individually adjusting the respective gains of the transmit amplifiers and the respective gains of the receive amplifiers, wherein:

a first gain of at least one transmit amplifier during a first transmission from the antenna is different from a second gain of the at least one transmit amplifier during a second transmission from the antenna, and a first gain of at least one receive amplifier during a first reception by the antenna is different from a second gain of the at least one receive amplifier during a second reception by the antenna.

16. The network element of claim 15, wherein the antenna permits transmitting a stream on the frequency wireless resource and receiving a different stream on the frequency wireless resource simultaneously.

17. A method comprising:

transmitting and receiving simultaneously on a same wireless resource using an antenna having a plurality of transmit antenna elements mounted on a first substrate and a plurality of receive antenna elements mounted on a second substrate, the plurality of transmit antenna elements and the plurality of receive antenna elements being partitioned by an electromagnetic isolation structure different from and directly between the first substrate and the second substrate, the transmitting comprising actively and individually adjusting the gains of gain-controlled transmit amplifiers, respectively coupled to each of the plurality of transmit antenna elements, using a beamforming processor, wherein a first gain of at least one transmit amplifier during a first transmission from the antenna is different from a second gain of the at least one transmit amplifier during a second transmission from the antenna; and the receiving comprising actively and individually adjusting the gains of gain-controlled receive amplifiers, respectively coupled to each of the plurality of receive antenna elements, using the beamforming processor, wherein a first gain of at least one receive amplifier during a first reception by the antenna is different from a second gain of the at least one receive amplifier during a second reception by the antenna.

18. The method of claim 17, wherein transmitting and receiving simultaneously on a same wireless resource comprises transmitting and receiving simultaneously on a same frequency wireless resource.

19. The method of claim 17, wherein adjusting the gains of the gain-controlled transmit amplifiers comprises respectively adjusting both amplitude and phase coefficients of transmitted signals for analog beamforming.

20. The method of claim 19, wherein the transmitting further comprises baseband digital precoding.

21. The method of claim 17, wherein adjusting the gains of the gain-controlled receive amplifiers comprises respectively adjusting both amplitude and phase coefficients of received signals for analog beamforming.

22. The method of claim 21, wherein the receiving further comprises at least one of baseband digital post-coding or baseband digital equalization.

23. The method of claim 17, wherein adjusting the gains of the gain-controlled transmit amplifiers comprises adjusting respective first amplitude and phase coefficients of transmitted signals having a first polarization and respective second amplitude and phase coefficients of transmitted signals having a second polarization.

24. The method of claim 17, wherein adjusting the gains of the gain-controlled receive amplifiers comprises adjusting respective first amplitude and phase coefficients of received signals having a first polarization and respective second amplitude and phase coefficients of received signals having a second polarization.

25. The method of claim 17, wherein transmitting and receiving simultaneously on the same wireless resource comprises transmitting a stream on the wireless resource and receiving a different stream on the wireless resource.

* * * * *